US007639206B2

(12) United States Patent
Behdad

(10) Patent No.: US 7,639,206 B2
(45) Date of Patent: Dec. 29, 2009

(54) LOW-PROFILE FREQUENCY SELECTIVE SURFACE BASED DEVICE AND METHODS OF MAKING THE SAME

(75) Inventor: Nader Behdad, Orlando, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 130 days.

(21) Appl. No.: 12/115,188

(22) Filed: May 5, 2008

(65) Prior Publication Data

US 2009/0273527 A1 Nov. 5, 2009

(51) Int. Cl.
*H01Q 15/02* (2006.01)

(52) U.S. Cl. ..... 343/909; 343/770; 333/202

(58) Field of Classification Search ..... 343/770, 343/895, 909; 333/134, 202
See application file for complete search history.

(56) References Cited

U.S. PATENT DOCUMENTS 5,563,614 A * 10/1996 Alden et al. ..... 343/701
5,592,186 A * 1/1997 Hoofe et al. ..... 343/909
6,208,316 B1 * 3/2001 Cahill ..... 343/909
6,218,978 B1 * 4/2001 Simpkin et al. ..... 342/5
6,448,936 B2 * 9/2002 Kopf et al. ..... 343/767
6,911,957 B2 6/2005 Brown et al.
7,250,921 B1 * 7/2007 Henry et al. ..... 343/909

OTHER PUBLICATIONS

Sarabandi, K., et al., "A Frequency Selective Surface with Miniaturized Elements," IEEE Transactions on Antennas and Propagation, vol. 55, No. 5, May 2007. pp. 1239-1245.

* cited by examiner

*Primary Examiner*—Tan Ho
(74) *Attorney, Agent, or Firm*—Patents on Demand, P.A.; Neil R. Jetter

(57) ABSTRACT

A frequency selective surface-based (FSS-based) device (200) for processing electromagnetic waves providing at least a third-order response. The FSS-based device includes a first FSS (202), a second FSS (210), and a high quality factor (Q) FSS (206) interposed between the first and second FSSs. A first dielectric layer (204) and a second dielectric layer (208) separate the respective FSS layers. The first and second FSSs have first and second primary resonant frequencies, respectively. The high Q FSS has a lower primary resonant frequency relative to the first and second primary resonant frequencies. The overall electrical thickness of the FSS device can be $<\lambda/10$. The high Q FSS has a loaded quality factor of at least thirty at the lower primary resonant frequency.

19 Claims, 12 Drawing Sheets

LOW-PROFILE FREQUENCY SELECTIVE SURFACE BASED DEVICE AND METHODS OF MAKING THE SAME

BACKGROUND

1. Statement of the Technical Field

The invention concerns frequency selective surfaces (FSSs). More particularly, the invention concerns FSS based devices and methods of making the same.

2. Background

FSSs are surface constructions generally comprising a periodic array of electrically conductive elements. As known in the art, in order for its structure to affect electromagnetic waves (EMs), the FSS must have structural features at least as small, and generally significantly smaller, as compared to the wavelength of the electromagnetic radiation it interacts with.

FSSs are typically used in a variety of antenna applications. Such antenna applications include, but are not limited to, radome applications, Dichroic sub-reflector applications, reflect array lens applications, spatial microwave applications, optical filter applications, radio frequency identification (RFID) tag applications, collision avoidance applications, waveguide applications, and low probability of intercept system applications.

A schematic illustration of a conventional multi-layer FSS 100 configured to achieve a higher-order filter response is shown in FIG. 1. The phrase "higher-order", as used herein, refers to an order greater than a first-order. As known in the art, in order to achieve a higher-order filter response, a plurality of first-order FSSs are cascaded by stacking respective FSSs to have a quarter wavelength spacing between each other.

FSS 100 is a third-order band-pass FSS and includes three (3) first-order FSSs $\mathbf{102}_1, \ldots, \mathbf{102}_3$ separated by two (2) dielectric layers $\mathbf{104}_1$, $\mathbf{104}_2$. Each of the first-order FSSs $\mathbf{102}_1, \ldots, \mathbf{102}_3$ can comprise an array of dipole or slot antennas that act as resonators around an operating frequency (e.g., 10 GHz) of the multi-layer FSS. Each of the dielectric layers $\mathbf{104}_1$, $\mathbf{104}_2$ act as an impedance inverter. The first-order FSSs $\mathbf{102}_1, \ldots, \mathbf{102}_3$ are cascaded so as to have a certain distance d between each other. The distance d is a physical distance defined by the physical thickness of the respective dielectric layer $\mathbf{104}_1$, $\mathbf{104}_2$. The physical distance d typically has a value which corresponds to an electrical thickness of one-fourth of a wavelength ($\lambda/4$). For a frequency of ten gigahertz (10 GHz), one millimeter (1 mm) corresponds to one-thirtieth of a wavelength ($\lambda/30$). The third-order band-pass FSS 100 has an overall physical thickness $t_{100}$. The physical thickness $t_{100}$ is defined by the collective physical thickness of the two (2) dielectric layers $\mathbf{104}_1$, $\mathbf{104}_2$ since the FSS layers have negligible physical thicknesses in relation to the dielectric layers. The physical thickness $t_{100}$ typically has a value that corresponds to an electrical thickness of one-half of a wavelength ($\lambda/2$). Thus, the physical thickness $t_{100}$ of a multi-layer FSS increases linearly as the order of the FSS increases.

Notably, conventional FSSs (such as the FSS 100 of FIG. 1) suffer from certain known deficiencies. For example, the significant physical thickness $t_{100}$ of the conventional FSS 100 results in an undesirable sensitivity of its response to the angle of incidence of the radiation. Also, the physical thickness $t_{100}$ of conventional multi-layer FSS 100 limits its applications, including applications where conformal FSSs are required. Therefore, there is a need for an improved higher-order FSS design.

SUMMARY

This Summary is provided to comply with 37 C.F.R. § 1.73, requiring a summary of the invention briefly indicating the nature and substance of the invention. It is submitted with the understanding that it will not be used to interpret or limit the scope or meaning of the claims.

Embodiments of the present invention concern frequency selective surface-based (FSS-based) devices for processing electromagnetic waves. The FSS-based device comprises at least three (3) FSSs. A first FSS has a first primary resonant frequency and a second FSS has a second primary resonant frequency. The FSS-based device also comprises a high quality factor (Q) FSS interposed between the first and second FSSs. The high Q FSS has a lower primary resonant frequency relative to the first and second primary resonant frequencies, which are generally at least thirty percent (30%) higher as compared to the high Q FSS. The high Q FSS has a loaded quality factor of at least thirty at its primary resonant frequency. The FSS-based device also comprises a first and second dielectric layer. The first dielectric layer is interposed between the first FSS and the high Q FSS, and the second dielectric layer is interposed between the second FSS and the high Q FSS. Significantly, the electrical thickness of the dielectric layers can be less than a twentieth of a wavelength ($\lambda/20$), or about at least an order of magnitude less than conventional multi-layers FSS designs. As a result, embodiments of the invention provide low-profile devices.

BRIEF DESCRIPTION OF THE DRAWINGS

Embodiments will be described with reference to the following drawing figures, wherein like numerals represent like items throughout the figures, and in which.

DETAILED DESCRIPTION

Embodiments of the invention provide low profile, multi-layer frequency selective surfaces (FSSs) for use in applications including filter applications, reflector applications, and transmission applications. In the filter applications, the low profile, multi-layer FSSs are designed to have higher-order filter responses (e.g., higher order bandpass frequency responses). The phrase "higher-order filter responses", as used herein, refers to an $N^{th}$-order filter response, where N has a value equal to or greater than three (e.g., N=3, 4, 5, 6, 7, . . . ). The $N^{th}$-order multi-layer FSSs have physical thicknesses $t_N$ less than the physical thicknesses $t_C$ of $N^{th}$-order conventional multi-layer FSSs (e.g., $t_N$<a value that corresponds to an electrical thickness of 0.1λ and $t_C$>a value that corresponds to an electrical thickness of 0.5λ, where 1 mm corresponds to λ/30 for a frequency of 10 GHz). As such, the $N^{th}$-order multi-layer FSSs can be used in applications where conformal multi-layer FSSs are required. Such applications include, but are not limited to, aircraft applications, missile applications, ship applications, and other propelled object or vehicle applications. FSSs according to embodiments of the invention have been found to provide low sensitivity's of response to angles of incidence of an incident plane wave. The low-profile, multi-layer FSSs can also be used in antenna applications, radome applications, beam former applications for large antenna arrays, radar cross section reduction applications, spaceborne deployable antenna array applications, electronic counter measure (ECM) applications, and electronic counter measure (ECCM) applications.

The invention will now be described more fully hereinafter with reference to accompanying drawings, in which illustrative embodiments of the invention are shown. This invention, may however, be embodied in many different forms and should not be construed as limited to the embodiments set forth herein.

Figure 2:
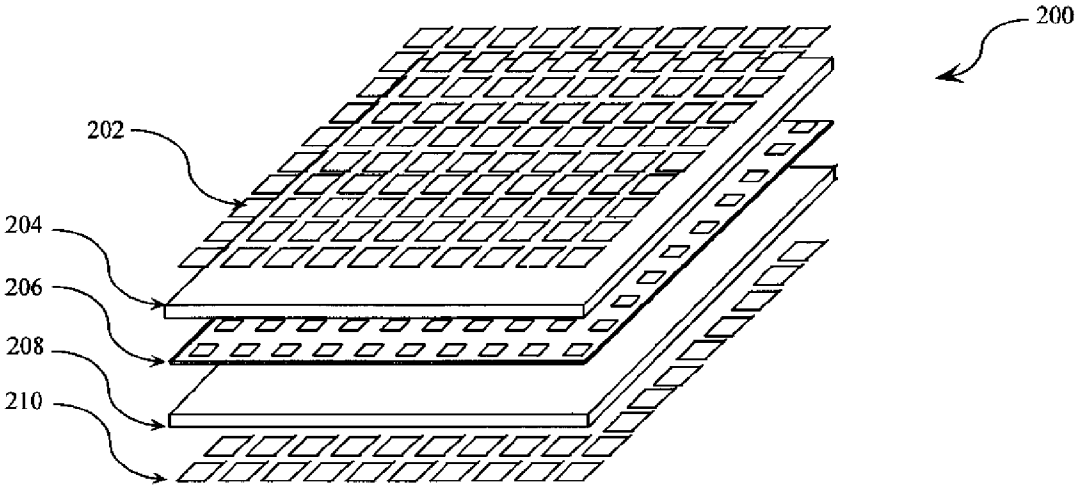
FIG. 2 is a schematic illustration of a multi-layer third-order low profile FSS topology according to an embodiment of the invention.

Referring now to FIG. 2, there is provided an enlarged perspective view of a third-order frequency selective surface (FSS) 200 topology according to an embodiment of the invention. A side view of a third-order FSS 200 is provided in FIG. 3. The third-order FSS 200 acts as a spatial band-pass filter with a third-order band-pass response. The phrase "third-order band-pass response", as used herein, refers to a filter response characteristic of a third-order system which comprises a sharper out-of-band rejection response as compared to the rejection provided by a second or first-order band-pass filter. Spatial band-pass filters are well known to those having ordinary skill in the art, and therefore will not be described herein. The third-order FSS 200 can be fabricated using any suitable fabrication technique known to those having ordinary skill in the art (e.g., a lithography technique).

Although the present invention will be described in relation to a third-order FSS 200, the invention is not limited in this regard. The following discussion of the third-order FSS 200 is sufficient for understanding the characteristics and features of other low profile $N^{th}$-order FSSs, where N has a value equal to or greater than three (e.g., N=5, 6, 7, . . . ). In this regard, it should be understood that the basic topology of the third-order FSS 200 can be cascaded to obtain higher-order frequency responses N (e.g., N=5, 6, 7, . . . ). As noted above, the term "cascade", as used herein, refers to a stacked arrangement of FSSs.

Figure 3:
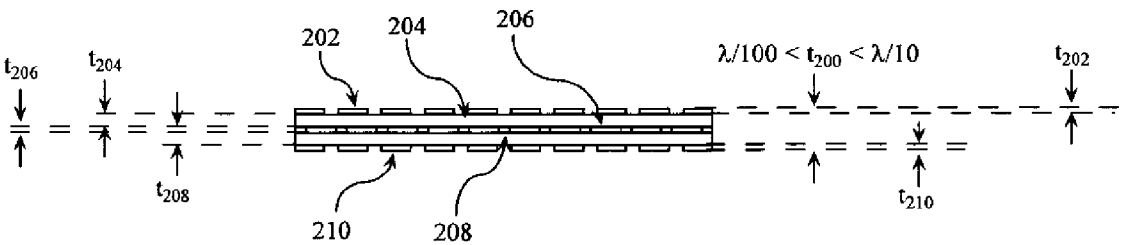
FIG. 3 is an enlarged side view of the multi-layer third-order low profile FSS of FIG. 2.

Referring now to FIGS. 2-3, the third-order FSS 200 is comprised of FSSs 202, 210, a high quality factor (Q) FSS 206, and dielectric layers 204, 208. The dielectric layer 204 is disposed between the FSS 202 and high Q FSS 206. The features on FSSs 202, 206 have respective dimensions including physical thicknesses $t_{202}$, $t_{206}$ and spacing's between one another selected in accordance with a particular third-order FSS 200 application (including application frequency). Similarly, the dielectric layer 208 is disposed between the high Q FSS 206 and FSS 210. The features of FSS 210 have dimensions including a physical thickness $t_{210}$ selected in accordance with a particular third-order FSS 200 application. The dielectric layers 204, 208 can be formed of the same dielectric material or different dielectric materials. The dielectric layers 204, 208 have respective dimensions including physical thicknesses $t_{204}$, $t_{208}$ selected in accordance with a particular third-order FSS 200 application. The particular application may also include the selection of the electrically conductive and dielectric materials used to fabricate FSS 200

The high Q FSS has a minimum quality factor Q at its primary resonant frequency. As should be understood, the phrase "quality factor" as used herein refers to a measure for the strength of a damping of a resonator's oscillations and a measure for a relative line-width of a resonator. The loaded quality factor Q can have a minimum value of at least thirty (30) as its primary resonant frequency. As should also be understood, the phrase "loaded quality factor", as used herein, refers to a specific mode of resonance of an FSS when there is external coupling to that mode. The high Q FSS 206 can have a primary resonant frequency that is lower than the primary resonant frequencies of the FSSs 202, 210. Accordingly, the high Q FSS 206 can resonate at a frequency of operation while the FSSs 202 and 210 (above and below FSS 206) can be non-resonant since their operation will be below their primary resonant frequency. The primary resonant frequency for FSS 206 can generally be selected to have a value ranging between five hundred megahertz to one hundred gigahertz (500 MHz-100 GHz).

According to an embodiment of the invention, the FSSs 202, 210 each have a resonant frequency of at least thirty percent (30%) higher or 1.3 times the primary resonant frequency of the high Q FSS 206. For example, the FSSs 202, 210 each can have a resonant frequency three (3) times higher than the resonant frequency of the high Q FSS 206. The invention is not limited in this regard.

The third-order FSS 200 has an overall physical thickness $t_{200}$. This physical thickness $t_{200}$ is substantially less than the overall physical thickness of a conventional third-order FSS (such as the FSS shown in FIG. 1). The phrase "substantially less" as used herein means that a physical thickness t of a conventional $N^{th}$-order FSS is reduced by a factor larger than or equal to fifty-percent (50%). For example, the overall physical thickness $t_{200}$ of the third-order FSS 200 generally has a value that corresponds to an electrical thickness falling between one-tenth of a wavelength (λ/10) and one-hundredth of a wavelength (λ/100). As described above, for a frequency of ten gigahertz (10 GHz), one millimeter (1 mm) corresponds to one-thirtieth of a wavelength (λ/30). In contrast, the overall physical thickness $t_{100}$ of the conventional third-order FSS 100 (shown in FIG. 1) has a value that corresponds to an electrical thickness of one-half of a wavelength (λ/2). The invention is not limited in this regard. The physical thickness of an $N^{th}$-order FSS according to an embodiment of the invention can have any value equal to the physical thickness of an $N^{th}$-order conventional FSS reduced by a factor larger than or equal to fifty (or 2%).

Figure 1:
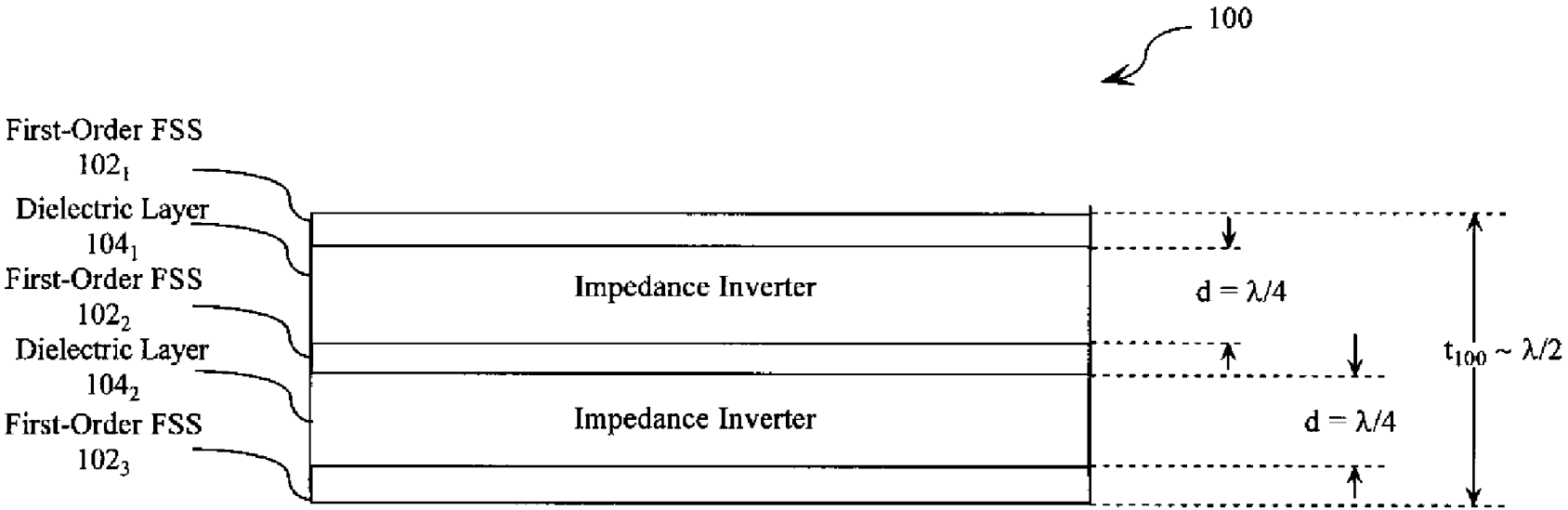
FIG. 1 (Prior Art)
FIG. 1 is a schematic illustration of a conventional multi-layer third-order frequency selective surface (FSS).
Figure 16:
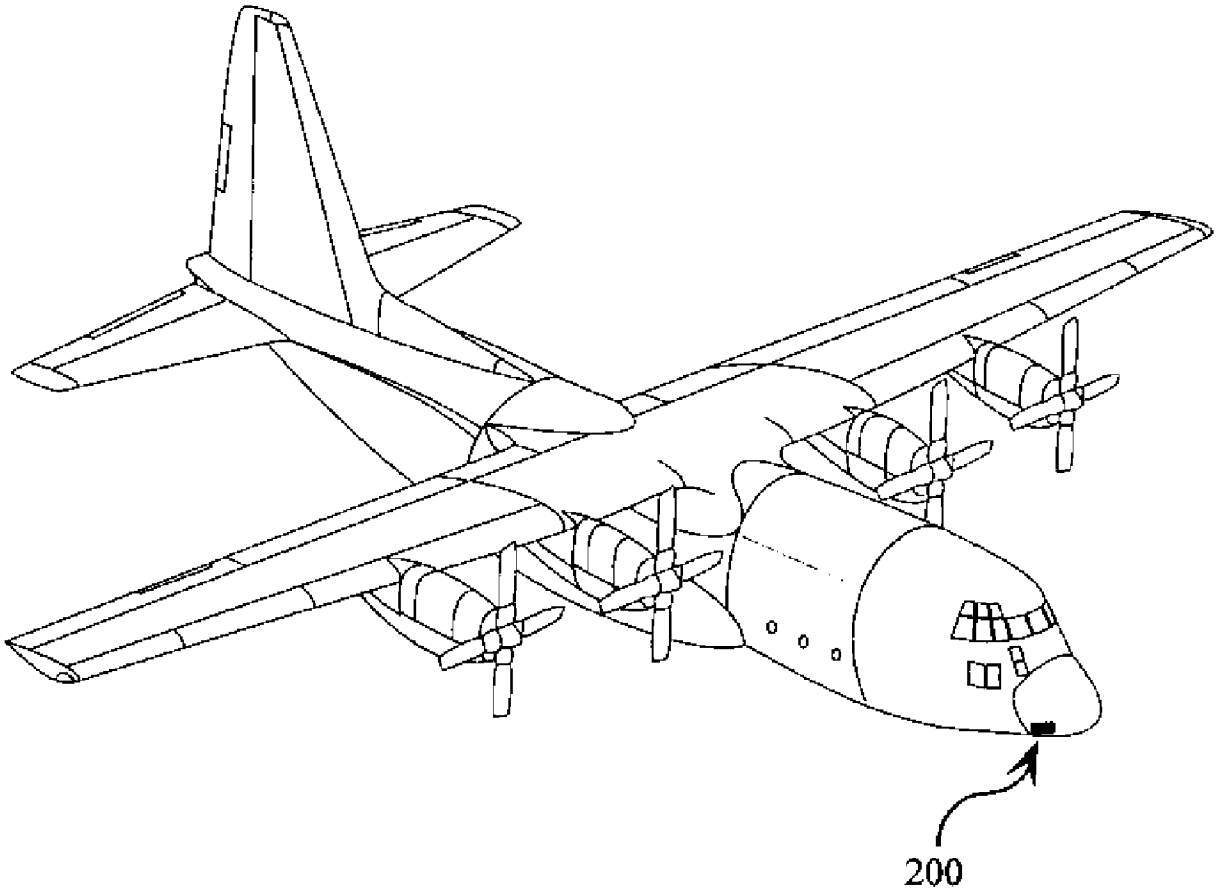
FIG. 16 is schematic illustration of an airplane with the FSS of FIGS. 2-3 disposed thereon.

This relatively small physical thickness $t_{200}$ provides a low-profile third-order FSS 200 that overcomes a particular non-conformal drawback of conventional third-order FSSs (such as the third-order FSS 100 shown in FIG. 1). Unlike conventional third-order FSSs (such as the third-order FSS shown in FIG. 1), the low-profile third-order FSS 200 can generally be used on conformal or curved surfaces. The conformal or curved surfaces can include, but are not limited to, the curved surfaces of aircrafts, missiles, ships, and other propelled object or vehicles. A schematic illustration of the low-profile third-order FSS 200 used on a curved surface of the nose of an aircraft is shown in FIG. 16.

Each FSS 202, 206, 210 of the third-order FSS 200 can generally be a two-dimensional periodic structure with sub-wavelength unit cell dimensions and/or periodicity. The phrase "unit cell" as used herein refers to a combination of resonant and non-resonant elements. The electrically small period and unit cell dimensions of the third-order FSS 200 allow for localization of band-pass characteristics to within a small area on a surface of the third-order FSS 200. This localization of band-pass characteristics facilitates flexible spatial filtering for an arbitrary wave phase-front. The small unit cell dimensions and overall physical thickness $t_{200}$ of the third-order FSS 200 generally results in a reduced sensitivity to an angle of incidence of an electromagnetic (EM) wave as compared to conventional third-order FSSs (such as the third-order FSS shown in FIG. 1). The sub-wavelength periodic structure allows for reducing an overall two-dimensional (2D) size of the third-order FSS 200. For example, if the third-order FSS 200 includes a sub-wavelength periodic structure, then the third-order FSS 200 can have an overall two-dimensional (2D) area corresponding to an electrical area of two wavelengths by two wavelengths (2λ by 2λ). The invention is not limited in this regard. The third-order FSS 200 can have an overall two-dimensional (2D) area selected in accordance with a particular third-order FSS 200 application. For example, if a two-dimensional (2D) area of an FSS 200 is defined by the dimensions of fifteen unit cells by fifteen unit cells, then the frequency response of the FSS 200 is a substantially infinite frequency response. Therefore, a desired frequency response can be obtained for a two-dimensional (2D) area defined by the dimensions of less than fifteen unit cells by fifteen unit cells.

Figure 14:
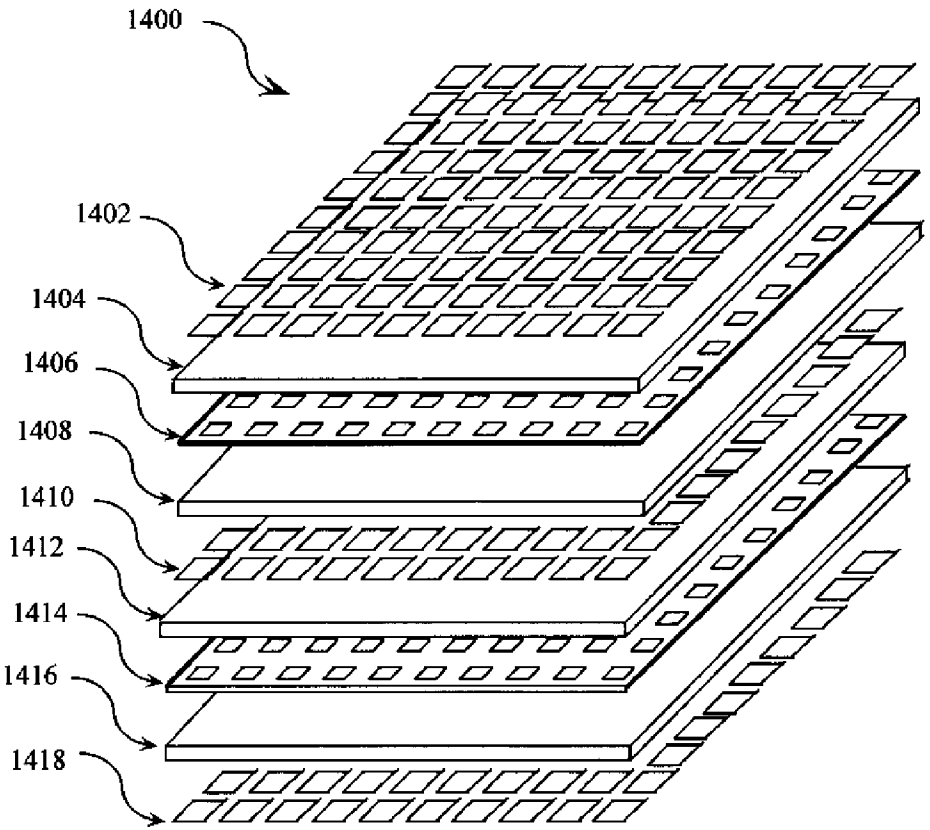
FIG. 14 is a schematic illustration of a multi-layer fifth-order FSS according to an embodiment of the invention.

A pair of third-order FSSs 200 can be stacked by sharing a common FSS layer to provide a higher than third-order FSS, such as a fifth-order FSS. The fifth-order FSS can have a low-profile (or physical thickness) corresponding to an electrical thickness on the order of one-fifth of a wavelength (λ/5) to a fiftieth of a wavelength (λ/50). This low-profile (or physical thickness) is substantially less than the profile (or physical thickness) of a conventional fifth-order FSS (i.e., a physical thickness of fifth-order FSS is above a wavelength). A schematic illustration of a fifth-order FSS 1400 according to an embodiment of the invention is provided in FIG. 14. As shown in FIG. 14, the first third-order FSS comprises FSSs 1410, 1406, and 1402 while the second third-order FSS comprises FSSs 1418, 1414, and 1410. FSSs 1406 and 1414 are the high Q FSS. Fifth-order FSS 1400 comprises dielectric layers 1404, 1408, 1412, 1416. The dielectric layers 1404, 1408, 1412, 1416 can be formed of the same dielectric material. The FSSs 1402, 1418 can include identical arrays of metallic elements. The FSS 1410 can have a capacitance greater than the capacitance of the FSSs 1402, 1418. The FSSs 1406, 1414 can be comprised of the same array of features (or "resonators"). The FSSs 1406, 1414 can have a primary resonant frequency lower than the primary resonant frequencies of the FSSs 1402, 1412, 1418. Accordingly, the FSSs 1406, 1414 can resonate at a frequency of operation having a value between five hundred megahertz to one hundred gigahertz (500 MHz-100 GHz). In contrast, the FSSs 1402, 1412, 1418 may not resonate at the frequency of operation. The invention is not limited in this regard.

Figure 4:
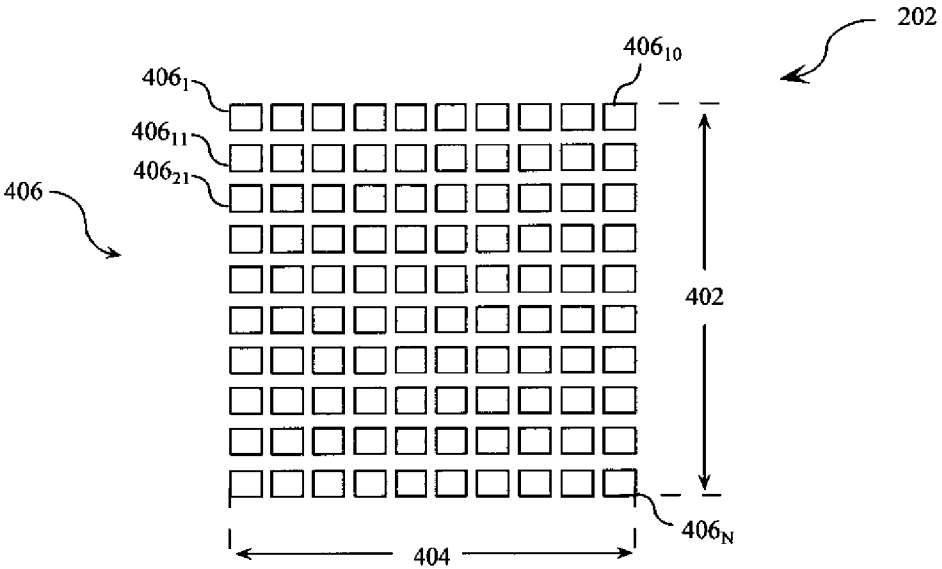
FIG. 4 is an enlarged top view of an FSS of the third-order low profile frequency selective surface shown in FIGS. 2-3.

An enlarged top view of the FSS 202 is provided in FIG. 4. It should be understood that the FSS 210 can be the same as or substantially similar to the FSS 202. As such, the following discussion of the FSS 202 is generally sufficient for understanding the FSS 210.

Referring now to FIG. 4, the FSS 202 shown is generally a two-dimensional periodic structure with an array 406 of electrically conductive elements $\mathbf{406}_1, \ldots, \mathbf{406}_N$. The array 406 can include a plurality of periodic electrically conductive structures (e.g., patches) disposed (or printed) on a dielectric layer 204 (described above in relation to FIGS. 2-3) of the FSS 200 or embedded in the dielectric layer 204. The periodic metallic structures (e.g., patches) can be disposed on the dielectric layer 204 using any suitable technique known in the art. Such techniques can include, but are not limited to, printing techniques and adhesion techniques. Each of the electrically conductive elements $\mathbf{406}_1, \ldots, \mathbf{406}_N$ can be formed of an electrically conductive material, such as metal. The array 406 can have a pre-selected length 402 and width 404. Each of the dimensions 402, 404 is selected in accordance with a particular third-order FSS 200 application.

Figure 5:
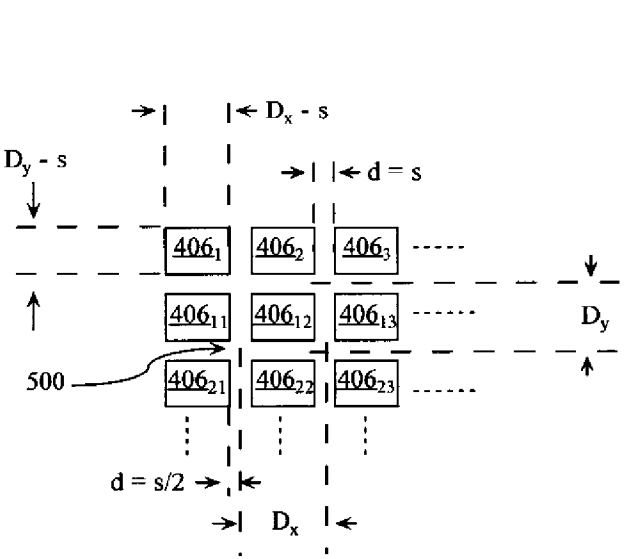
FIG. 5 is an enlarged top view of an array of electrically conductive elements shown in FIG. 4.

An enlarged top view of electrically conductive elements $\mathbf{406}_1$, $\mathbf{406}_2$, $\mathbf{406}_3$, $\mathbf{406}_{11}$, $\mathbf{406}_{12}$, $\mathbf{406}_{21}$, $\mathbf{406}_{22}$, $\mathbf{406}_{23}$ is provided in FIG. 5. It should be understood that the following discussion is sufficient for understanding the geometries of each electrically conductive element $\mathbf{406}_1, \ldots, \mathbf{406}_N$ and inter-element spacing of the electrically conductive elements $\mathbf{406}_1, \ldots, \mathbf{406}_N$. It should also be understood that the geometries and inter-element spacing contribute to a determination of an overall frequency response of FSS 202 and thus the third-order FSS 200. As such, each of the electrically conductive elements can have an arbitrary geometry selected in accordance with a particular FSS 200 application. Such an arbitrary geometry can include, but is not limited to, a rectangular geometry (such as the square geometry shown in FIGS. 4-5) and a rectangular geometry with at least one set of digits (not shown).

As shown in FIG. 5, each unit cell 500 has a pre-selected physical length $D_y$ and physical width $D_x$. The physical length $D_y$ has a maximum value corresponding to an electrical dimension equal to a period of the third-order FSS 200 in a y direction of a two-dimensional (2D) space. Similarly, the physical width $D_x$ has a maximum value corresponding to an electrical dimension equal to a period of the third-order FSS 200 in an x direction of a two-dimensional (2D) space. Each unit cell 500 is comprised of a dielectric portion with a pre-selective physical width d=s/2, where s is the distance between adjacent electrically conductive elements. Each unit cell 500 is also comprised of a conductive portion defined by an electrically conductive element $\mathbf{406}_1$, $\mathbf{406}_2$, $\mathbf{406}_3$, $\mathbf{406}_{11}$, $\mathbf{406}_{12}$, $\mathbf{406}_{21}$, $\mathbf{406}_{22}$, $\mathbf{406}_{23}$.

Each of the electrically conductive elements $\mathbf{406}_1$, $\mathbf{406}_2$, $\mathbf{406}_3$, $\mathbf{406}_{11}$, $\mathbf{406}_{12}$, $\mathbf{406}_{21}$, $\mathbf{406}_{22}$, $\mathbf{406}_{23}$ is separated from adjacent electrically conductive elements by a pre-selected physical distance d=s. Each of the electrically conductive elements $\mathbf{406}_1$, $\mathbf{406}_2$, $\mathbf{406}_3$, $\mathbf{406}_{11}$, $\mathbf{406}_{12}$, $\mathbf{406}_{21}$, $\mathbf{406}_{22}$, $\mathbf{406}_{23}$ has a pre-selected length $D_y$−s and width $D_x$−s. Each of the dimensions $D_y$–s, $D_x$–s is selected in accordance with a particular FSS 200 application. For example, each of the dimensions has $D_y$–s, $D_x$–s corresponding to an electrical dimension of less than one-wavelength. In effect, the FSS 202 comprising electrically conductive elements $\mathbf{406}_1$, $\mathbf{406}_2$, $\mathbf{406}_3$, $\mathbf{406}_{11}$, $\mathbf{406}_{12}$, $\mathbf{406}_{21}$, $\mathbf{406}_{22}$, and $\mathbf{406}_{23}$ is non-resonant at a frequency of operation (e.g., 10 GHz). The periodic arrangement of the electrically conductive elements $\mathbf{406}_1$, $\mathbf{406}_2$, $\mathbf{406}_3$, $\mathbf{406}_{11}$, $\mathbf{406}_{12}$, $\mathbf{406}_{21}$, $\mathbf{406}_{22}$, $\mathbf{406}_{23}$ presents a capacitive impedance in both directions to an incident electromagnetic (EM) wave.

Figure 6:
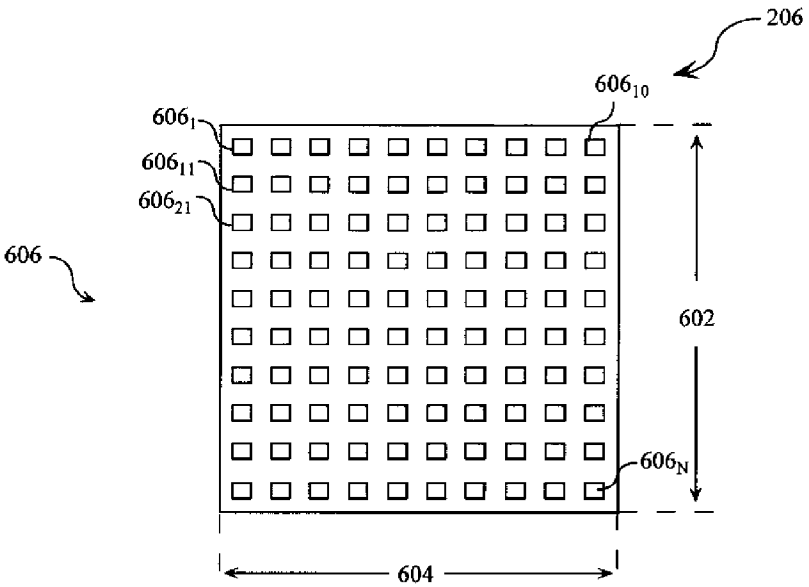
FIG. 6 is an enlarged top view of a high quality factor FSS of the third-order low profile frequency selective surface shown in FIGS. 2-3.

Referring now to FIG. 6, there is provided an enlarged top view of the high Q FSS 206 shown in FIGS. 2-3. The high Q FSS 206 can generally be defined as a two-dimensional periodic structure with an array 606 of dielectric features $\mathbf{606}_1, \ldots, \mathbf{606}_N$. The array 606 of features $\mathbf{606}_1, \ldots, \mathbf{606}_N$ can be etched in an electrically conductive layer using any suitable etching technique known in the art. Each of the dielectric features $\mathbf{606}_1, \ldots, \mathbf{606}_N$ can generally comprise a slot resonator. The array 406 of features $\mathbf{606}_1, \ldots, \mathbf{606}_N$ can have pre-selected dimensions, such as a physical length 602 and a physical width 604. Each of the dimensions 602, 604 is selected in accordance with a particular third-order FSS 200 application.

Figure 7:
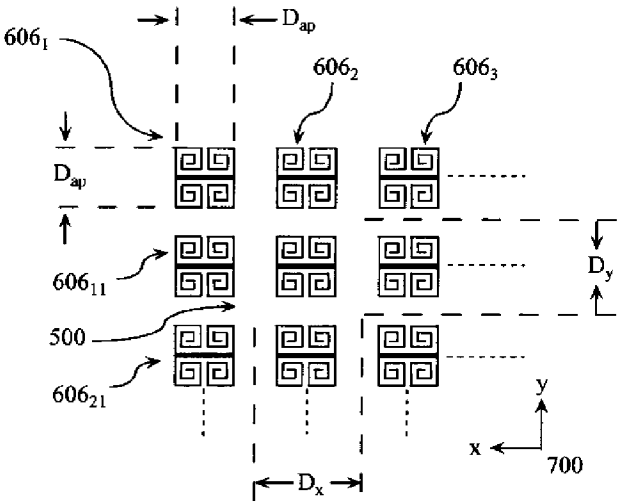
FIG. 7 is an enlarged top view of an array of slot antenna apertures shown in FIG. 6.
Figure 15:
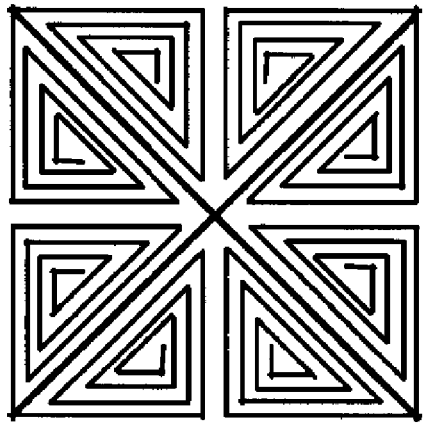
FIG. 15 is an enlarged top view of a slot antenna according to an embodiment of the invention.

An enlarged top view of features $\mathbf{606}_1$, $\mathbf{606}_2$, $\mathbf{606}_3$, $\mathbf{606}_{11}$, $\mathbf{606}_{12}$, $\mathbf{606}_{21}$, $\mathbf{606}_{22}$, $\mathbf{606}_{23}$ is provided in FIG. 7. It should be understood that the following discussion is sufficient for understanding the geometries of each feature $\mathbf{606}_1, \ldots, \mathbf{606}_N$ and inter-element spacing of the features $\mathbf{606}_1, \ldots, \mathbf{606}_N$. It should also be understood that the geometries and inter-element spacing contribute to a determination of an overall frequency response of the third-order FSS 200. As such, each of the features $\mathbf{606}_1, \ldots, \mathbf{606}_N$ can have an arbitrary geometry selected in accordance with a particular FSS 200 application. A schematic illustration of a feature $\mathbf{606}_1$ having a first type of geometry according to an embodiment of the invention is provided in FIG. 8. A schematic illustration of a feature having a second type of geometry according to an embodiment of the invention is provided in FIG. 15. It should be noted that the feature shown in FIG. 15 is a dual-polarized crossed slot antenna comprising two straight slots arranged so as to form a cross, wherein each straight slot is connected to two (2) balanced spirals at each of its ends.

Figure 8:
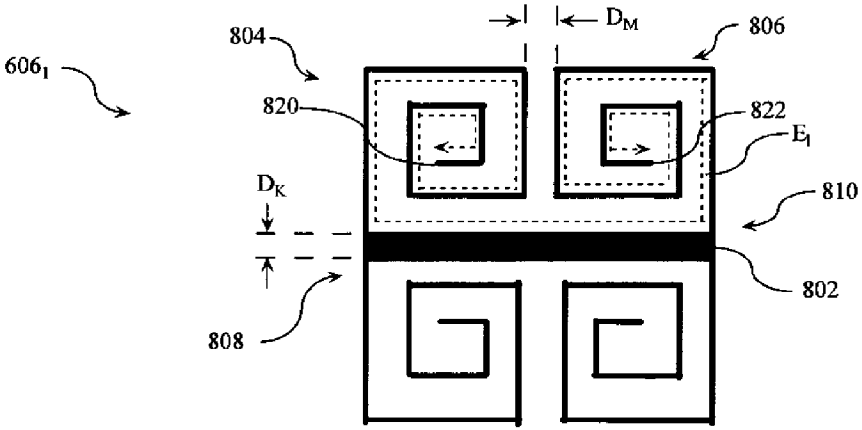
FIG. 8 is an enlarged top view of a slot antenna shown in FIGS. 6-7.

Referring now to FIG. 8, the feature $\mathbf{606}_1$ has an exemplary arbitrary geometry defined by electrically conductive portions including a straight slot section 802 connected to two (2) balanced spirals 804, 806 at each end 808, 810. The straight slot section 802 has a physical width of $D_K$ selected in accordance with a particular third-order FSS 200 application. Each spiral of the spirals 804 is separated from an adjacent spiral of the spirals 806 by a certain physical distance $D_M$. The physical distance $D_M$ is also selected in accordance with a particular third-order FSS 200 application.

The effective electrical length $E_1$ of the feature $\mathbf{606}_1$ extends from a first end of a first balanced spiral 820 to the corresponding end of a second balanced spiral 822. According to an embodiment of the invention, the effective electrical length $E_1$ of the feature $\mathbf{606}_1$ has a value equal to half of a wavelength ($\lambda/2$). In such a scenario, the feature $\mathbf{606}_1$ is a resonant structure acting as a magnetic Herzian dipole. Magnetic Herzian dipoles are well known to those having ordinary skill in the art, and therefore will not be described herein. The invention is not limited in this regard. The effective electrical length $E_1$ of the feature $\mathbf{606}_1$ can have any value selected in accordance with a particular third-order FSS application.

Referring again to FIG. 7, each of the features $\mathbf{606}_1$, $\mathbf{606}_2$, $\mathbf{606}_3$, $\mathbf{606}_{11}$, $\mathbf{606}_{12}$, $\mathbf{606}_{21}$, $\mathbf{606}_{22}$, $\mathbf{606}_{23}$ has the same overall physical length and physical width having values equal to $D_{ap}$. In this regard, it should be understood that the overall area of a feature is significantly smaller than a conventional dipole or slot antenna of a first-order FSS (such as that shown in FIG. 1). For example, each features $\mathbf{606}_1$, $\mathbf{606}_2$, $\mathbf{606}_3$, $\mathbf{606}_{11}$, $\mathbf{606}_{12}$, $\mathbf{606}_{21}$, $\mathbf{606}_{22}$, $\mathbf{606}_{23}$ has an overall physical area of $D_{ap} \times D_{ap}$, where $D_{ap}$ is a fraction of a unit cell size, i.e., $D_{ap} < D_x$, $D_y$. Each of the features $\mathbf{606}_1$, $\mathbf{606}_2$, $\mathbf{606}_3$, $\mathbf{606}_{11}$, $\mathbf{606}_{12}$, $\mathbf{606}_{21}$, $\mathbf{606}_{22}$, $\mathbf{606}_{23}$ is a single polarized feature capable of resonating an electric field polarized in a "y" direction of a two-dimensional (2D) space 700. In effect, the frequency response of the third-order FSS 200 becomes polarization sensitive.

Figure 9A:
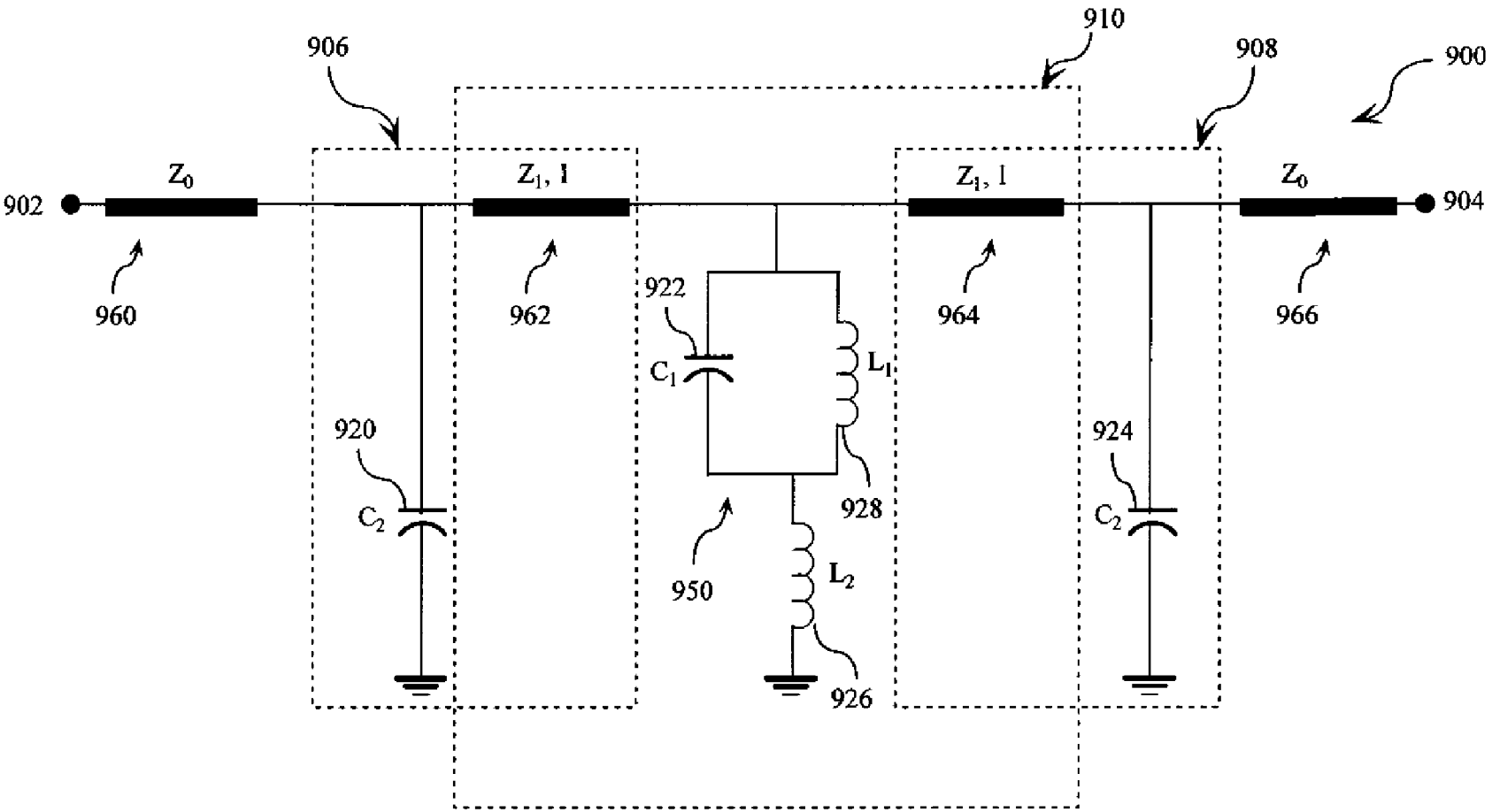
FIG. 9A is a first exemplary equivalent circuit for the multi-layer third-order low profile FSS shown in FIGS. 2-3.

Referring now to FIG. 9A, there is provided an equivalent circuit 900 for the third-order FSS 200 (described above in relation to FIGS. 2-7). The equivalent circuit 900 is generally that of a third-order band-pass microwave filter. The operations of a third-order band-pass microwave filter are well known to those having ordinary skill in the art, and therefore will not be described herein. However, a brief discussion of the equivalent circuit 900 is provided to assist a reader in understanding the present invention.

As shown in FIG. 9A, the equivalent circuit 900 is comprised of an input terminal 902, an output terminal 904, capacitors 920, 924, an inductor 926, a feature 950, and short sections of a transmission line (SSTL) 960, 962, 964, 966. The capacitors 920, 924 are connected in parallel between terminals 902, 904 and ground. Each of the capacitors 920, 924 has a capacitance $C_2$.

The feature 950 is a circuit equivalent of a feature $\mathbf{606}_1, \ldots, \mathbf{606}_N$ (described above in relation to FIGS. 6-8). As shown in FIG. 9A, the feature 950 is comprised of a capacitor 922 connected in parallel with an inductor 928. The capacitor 922 has a capacitance $C_1$. The inductor 928 has an inductance $L_1$. The feature 950 is connected in series with the inductor 926 having an inductance $L_2$. The inductor 926 represents a parasitic inductance associated with an electric current flowing in a ground plane of the high Q FSS 206 (described above in relation to FIGS. 6-8), wherein resonant slots are etched in the ground plane. Each of these slots defines a slot antenna. The slot antenna resonates at a frequency determined by the shape of the resonant slots. The inductor 926 is associated with the electric current which has an inductance value inversely proportional to the cross sectional area of the conductor.

The feature 950 is connected in parallel with the capacitors 920, 924. The capacitors 920, 924 represent FSSs 202, 210 (described above in relation to FIGS. 2-3) of the third-order FSS 200 (described above in relation to FIGS. 2-3). The feature 950 is separated from the capacitors 920, 924 with SSTLs 962, 964, respectively. The SSTLs 962, 964 represent the dielectric layer 204, 208 (described above in relation to FIGS. 2-3) of the third-order FSS 200 (described above in relation to FIGS. 2-3). As such, each of the SSTLs 962, 964 has a characteristic impedance $Z_1$ and a length l. The length l of each SSTLs 962, 964 has a value equal to the physical thickness $t_{204}$, $t_{206}$ of a dielectric layer 204, 208 (described above in relation to FIGS. 2-3). The characteristic impedance $Z_1$ of each SSTLs 962, 964 can be defined by the following mathematical equation (1).

$$Z_1 = Z_0/(\in_r)^{1/2} \tag{1}$$

where $Z_0$ equals three hundred seventy-seven ohms (the impedance of free space). $\in_r$ is a dielectric constant of dielectric layers 204, 208 (described above in relation to FIGS. 2-3).

The SSTLs 960, 966 represent free space provided on both sides of the third-order FSS 200 (described above in relation to FIGS. 2-3). Each of the SSTLs 960, 966 is a semi-infinite transmission line with a characteristic impedance $Z_0$.

Figure 9B:
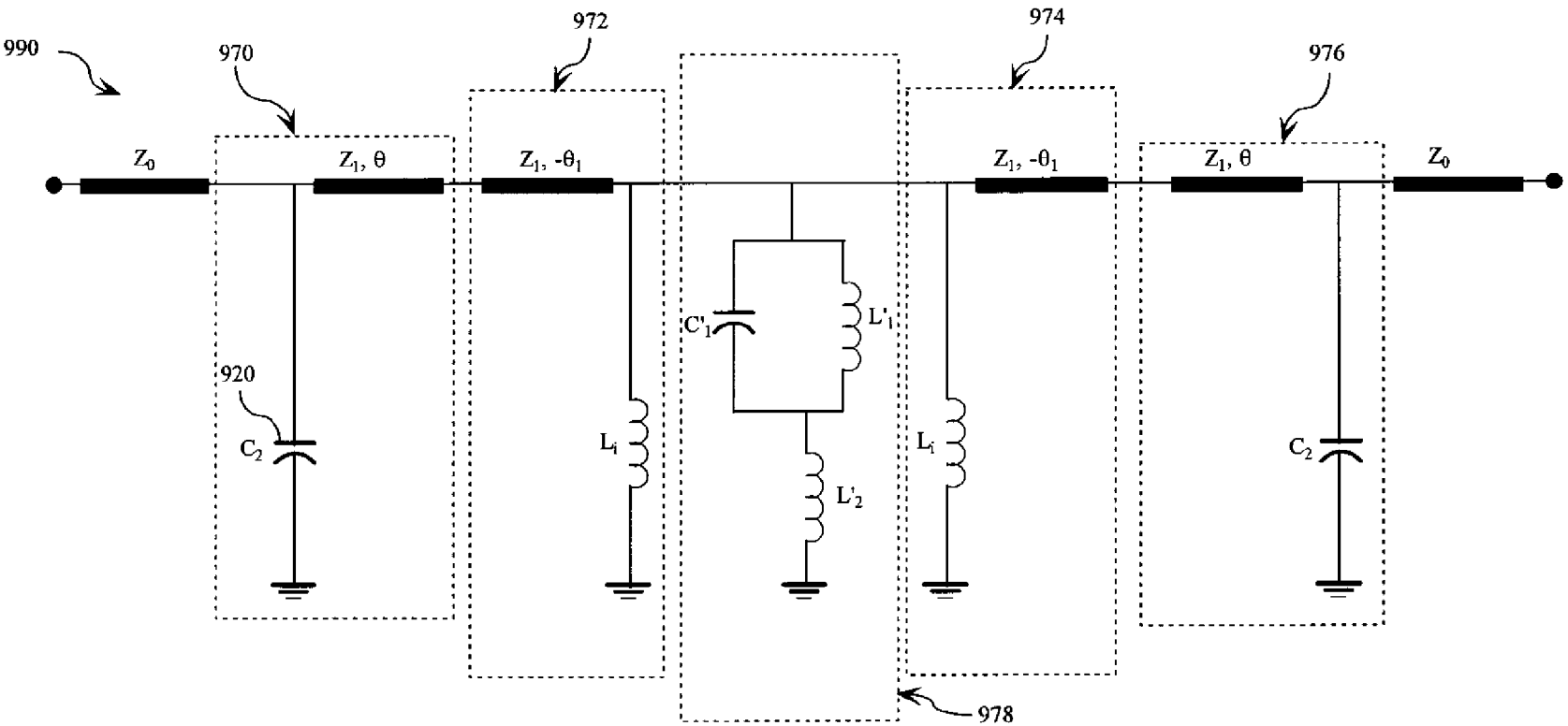
FIG. 9B is a second exemplary equivalent circuit for the multi-layer third-order low profile FSS shown in FIGS. 2-3.

Although not required to practice the invention, applicant provides the following theoretical background which is helpful to explain the operations of the multi-layer FSS structure 200. Referring now to FIG. 9B, there is provided an expanded equivalent circuit model 990 for the third-order FSS 200 (described above in relation to FIGS. 2-7). As shown in FIG. 9B, the equivalent circuit 990 is comprised of impendence inverters 972, 974, capacitive loaded transmission lines (CLTLs) 970, 976, and a parallel LC resonator 978. Each of the impendence inverters 972, 974 is an inductive network with a transmission line having a "negative" electrical length. The principles and operation of impendence inverters are well known to those having ordinary skill in the art, and therefore will not be described herein. Each of the impendence inverters 972, 974 is interposed between a respective CLTL 970, 976 and the parallel LC resonator 978. The combination of these circuit components 970, 972, 974, 976, 978 results in a third-order band-pass filter. By comparing the equivalent circuits 900, 990, it is observed that the "negative" electrical length of each transmission line used in the impendence inverters 972, 974 is absorbed in a "positive" electrical length of a respective CLTL 970, 976. The inductors $L_i$ of the impendence inverters 972, 974 are absorbed in the parallel LC resonator 978.

Figure 10:
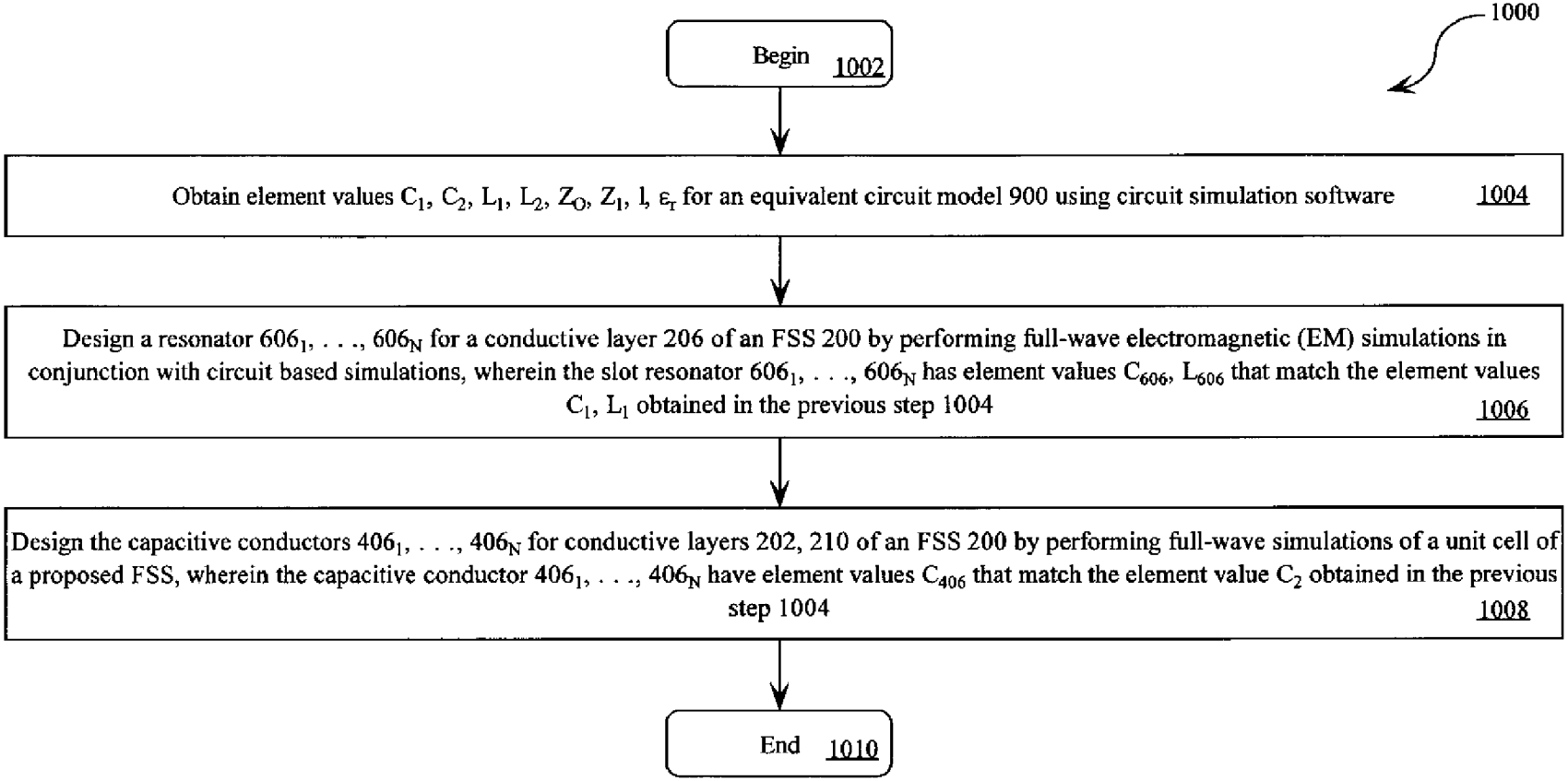
FIG. 10 is a flow diagram of a design process according to an embodiment of the invention for designing the multi-layer third-order low profile FSS shown in FIGS. 2-3.

The following FIG. 10 and accompanying text illustrate a design process 1000 for designing an $N^{th}$-order FSS according to an embodiment of the invention (such as the third-order FSS 200 of FIGS. 2-8). It should be appreciated, however, that the design process disclosed herein is provided for purposes of illustration only and that the present invention is not limited solely to the design process shown.

Referring now to FIG. 10, the design process 1000 begins at step 1002 and continues with step 1004. In step 1004, element values $C_1$, $C_2$, $L_1$, $L_2$, $Z_0$, $Z_1$, l, $\in_r$ are obtained for an equivalent circuit 900. These element values can be obtained using any suitable circuit simulation software known to those having ordinary skill in the art. Such circuit simulation software includes, but is not limited to, Advanced Design Systems available from Agilent Technologies of Santa Clara, Calif.

According to an embodiment of the invention, each of the dielectric layers 204, 208 of a third-order FSS 200 is formed of a dielectric substrate having a physical thickness of half a millimeter ($t_{204}$=0.5 mm, $t_{206}$=0.5 mm). The equivalent circuit 900 has a band-pass frequency response with a center frequency of operation of ten gigahertz (10 GHz) and a fractional bandwidth of twenty percent (20%). In such a scenario, the equivalent circuit 900 element values obtained in step 1004 of design process 1000 can be defined as: $C_1$=22.2 pF; $C_2$ 0.38 pF; $L_1$=108 pH; $L_2$=147 pH; $Z_0$=377Ω; $Z_1$=254Ω; 1=0.5 mm; and $\in_r$=2.2. The invention is not limited in this regard.

Referring again to FIG. 10, the design process 1000 continues with step 1006. In step 1006, a feature $\mathbf{606}_1, \ldots, \mathbf{606}_N$ is designed for a high Q FSS 206 (described above in relation to FIGS. 2-3) of a third-order FSS 200 (described above in relation to FIGS. 2-3). The feature $\mathbf{606}_1, \ldots, \mathbf{606}_N$ can be designed by performing full-wave electromagnetic (EM) simulations in conjunction with a circuit based simulation. The feature $\mathbf{606}_1, \ldots, \mathbf{606}_N$ can be designed so that it has element values $C_{606}$, $L_{606}$ matching the element values $C_1$, $L_1$ obtained in the previous step 1004.

According to an embodiment of the invention, the feature $\mathbf{606}_1, \ldots, \mathbf{606}_N$ can generally be a slot antenna composed of a straight slot section 802 connected to two (2) balanced spirals 804, 806 at each end 808, 810. The effective electrical length $E_1$ of the feature $\mathbf{606}_1$ has a value approximately equal to half of a wavelength (λ/2). As such, the feature $\mathbf{606}_1$ is a resonant structure acting as a magnetic Herzian dipole. The quality factor Q of the feature $\mathbf{606}_1, \ldots \mathbf{606}_N$ is inversely proportional to the area ($D_{ap} \cdot D_{ap}$) occupied by the features $\mathbf{606}_1, \ldots, \mathbf{606}_N$. The quality factor Q of the features $\mathbf{606}_1, \ldots, \mathbf{606}_N$ can be increased by reducing the area ($D_{ap} \cdot D_{ap}$) occupied by the features $\mathbf{606}_1, \ldots, \mathbf{606}_N$ while maintaining the resonant frequency of the features $\mathbf{606}_1, \ldots \mathbf{606}_N$In effect, the desired element values $L_1$, $C_1$ can be obtained by selecting aperture dimensions of the features $\mathbf{606}_1, \ldots, \mathbf{606}_N$ for a constant resonant frequency. The invention is not limited in this regard.

According to an embodiment of the invention, step 1006 involves designing a feature $\mathbf{606}_1, \ldots, \mathbf{606}_N$ using full-wave electromagnetic (FWEM) simulations in conjunction with circuit based simulation. In such a scenario, a portion of a unit cell (PUC) of a proposed third-order FSS is simulated by performing full-wave electromagnetic (EM) simulations using HFSS® simulation software available from Ansoft Corporation of Pittsburg, Pa. A schematic illustration of a simulation model 1100 including a topology for the PUC is provided in FIG. 11A. As shown in FIG. 11A, the PUC 1102 can comprise a feature 1122 sandwiched between two dielectric substrates 1120, 1124. The PUC 1102 is placed in a waveguide 1130. The waveguide 1130 has periodic boundary conditions for emulating an infinite structure. Step 1006 also involves performing Finite Element Method (FEM) simulations to calculate transmission and reflection coefficient of a vertically polarized transverse electromagnetic (TEM) wave. Step 1006 further involves performing a circuit based (CB) simulation of a relevant portion 910 of an equivalent circuit 900 (described above in relation to FIG. 9A). After performing the FWEM, FEM, and CB simulations, a matching process is performed. This matching process can generally involve matching the results of the FWEM simulations to results obtained from the CB simulation. The matching process can also involve modifying the dimensions of a feature 1122 in accordance with the outcome of matching the FWEM and CB simulation results. This matching process can be iteratively performed until a frequency response obtained through the FWEM simulations are matched to the frequency response of the relevant portion 910 of an equivalent circuit 900 (described above in relation to FIG. 9A). The invention is not limited in this regard.

Referring again to FIG. 10, the design process 1000 continues with step 1008. In step 1008, the electrically conductive elements $\mathbf{406}_1, \ldots, \mathbf{406}_N$ are designed for an FSS 202, 210 (described above in relation to FIGS. 2-3) of a third-order FSS 200 (described above in relation to FIGS. 2-3). The electrically conductive elements $\mathbf{406}_1, \ldots, \mathbf{406}_N$ can be designed by performing full-wave simulations of a unit cell for a proposed FSS. The electrically conductive elements $\mathbf{406}_1, \ldots, \mathbf{406}_N$ can be designed so that they have element values $C_{406}$ matching the element values $C_2$ obtained in the previous step 1004.

Figure 11B:
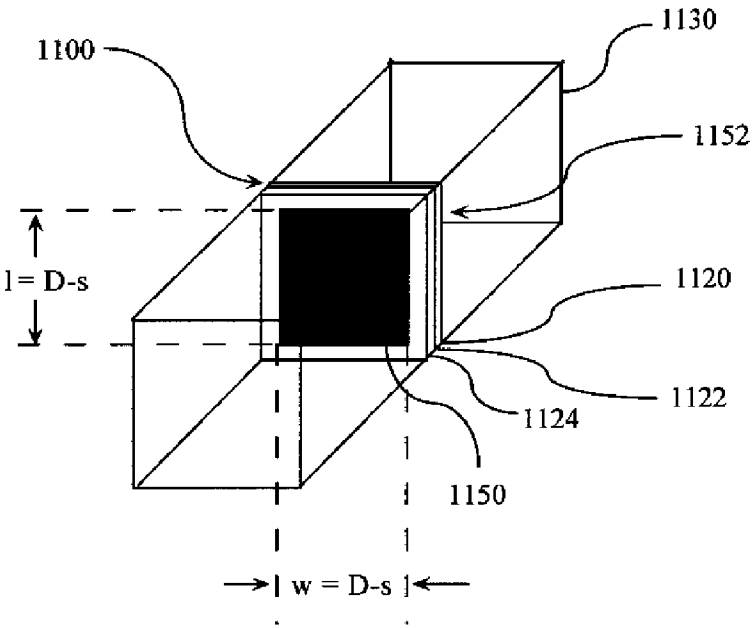
FIG. 11B is a schematic illustration of a transmission line model of the equivalent circuit shown in FIG. 9A.
Figure 11A:
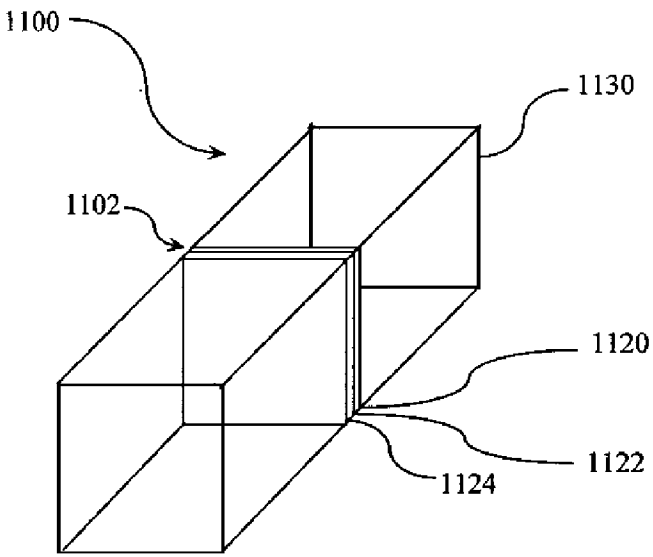
FIG. 11A (Prior Art)
FIG. 11A is a schematic illustration of a transmission line model of a slot antenna loaded with a lumped capacitor.

According to an embodiment of the invention, the electrically conductive elements $\mathbf{406}_1, \ldots, \mathbf{406}_N$ are designed by adding two (2) electrically conductive elements 1150, 1152 to the full-wave simulation model 1100 (as shown in FIG. 11B). The two (2) electrically conductive elements 1150, 1152 correspond to a capacitor 920, 924 (described above in relation to FIG. 9A) of the equivalent circuit 900 (described above in relation to FIG. 9A). The electrically conductive elements 1150, 1152 are sub-wavelength, non-resonant patches with physical lengths 1=D−s and physical widths w=1=D−s, where D has a value corresponding to the period of the full-wave simulation model 1100 and s is the distance between adjacent electrically conductive elements of a proposed FSS. D can have a value equal to the physical length $D_y$ and physical width $D_x$ of a unit cell. The initial dimension 1 of the electrically conductive elements 1150, 1152 is approximated using the following mathematical equation (2).

$$C=\in_0\in_{eff}[(2(D-s))/\pi]\log[1/(\sin(\pi s/(2(D-s))))] \quad (2)$$

where C is a capacitance of a electrically conductive element of an FSS measured in Farads. $\in_0$ is the permittivity of free space and has value of $8.85\cdot10^{-12}$ F/m. $\in_{eff}$ is the effective dielectric constant of the dielectric layers 204, 208 (described above in relation to FIGS. 2-3). D is a unit cell dimension corresponding to the periodicity of an FSS, where $D_x=D_y=Ds$ is a physical distance between two adjacent electrically conductive elements of the FSS. π has a value equal to 3.1415.

After adding the electrically conductive elements 1150, 1152 to the full-wave simulation model 1100, full-wave simulations are performed using the modified full-wave simulation model 1100 (as shown in FIG. 11B). It should be noted that the modified full-wave simulation model 1100 shown in FIG. 11B represents a unit cell of a proposed FSS. Upon completing the full-wave simulations, the physical dimensions 1, w of the electrically conductive elements 1150, 1152 are adjusted based on the results of the full-wave simulations. This full-wave simulation and dimension adjustment process is repeated until the frequency response of the modified full-wave simulation model 1100 matches a desirable frequency response of a proposed multi-layer FSS. The invention is not limited in this regard.

The following Example is provided in order to further illustrate the design process 1000. The scope of the invention, however, is not to be considered limited in any way thereby.

EXAMPLE

A third-order FSS 200 having an equivalent circuit 900 was designed using design process 1000. The circuit elements of the equivalent circuit 900 used in the design process 1000 were defined as: $C_1$=22.2 pF; $C_2$=0.38 pF; $L_1$=108 pH; $L_2$=147 pH; $Z_0$=377Ω; $Z_1$=254Ω; 1=0.5 mm; and $\in_r$=2.2. The physical and geometrical parameters for the third-order FSS 900 obtained during the design process 1000 were defined as: $D_x$=5.5 mm; $D_y$=5.5 mm; $t_{200}$=0.5 mm; $\in_r$=2.2; s=60 μm; and $D_{ap}$=1.46 mm.

Figure 12:
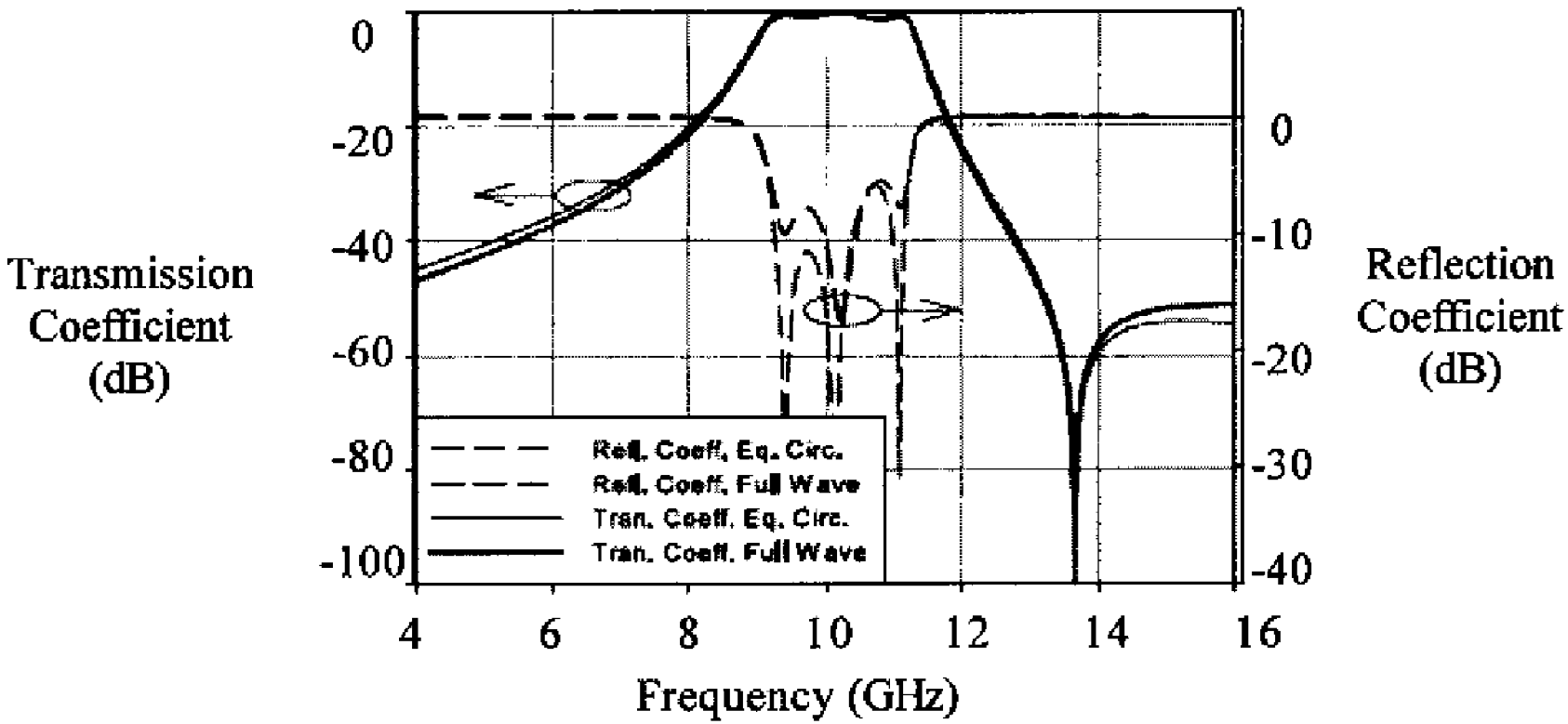
FIG. 12 is a graph illustrating a frequency response of an FSS according to an embodiment of the invention obtained from full-wave electromagnetic simulations and frequency responses predicted by an equivalent circuit model.
Figure 13:
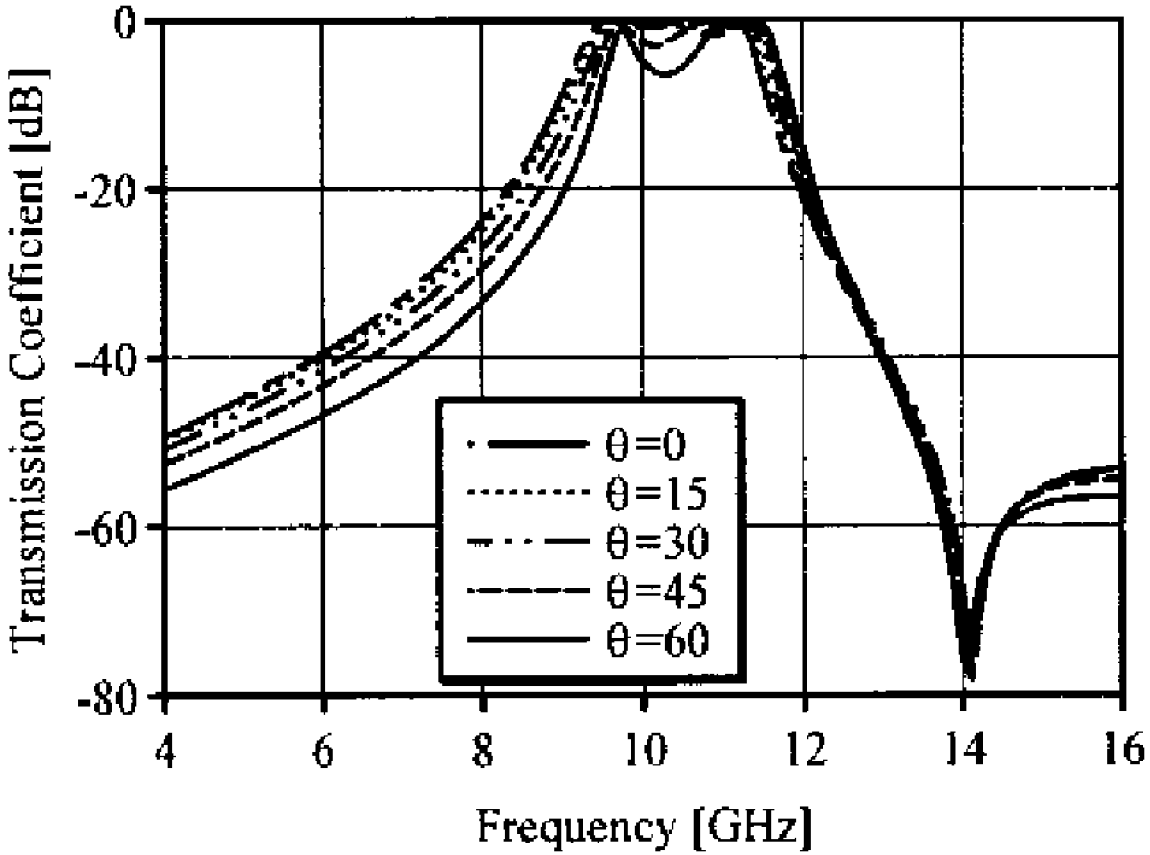
FIG. 13 is a graph illustrating a transmission coefficient of an FSS according to an embodiment of the invention for an obliquely incident plane wave for various angles of incidence ranging from θ=0° to 60°.

The frequency response between four and sixteen gigahertz (4 GHz-16 GHz) of the third-order FSS 200 obtained from FWEM simulations is shown graphically in FIG. 12. The frequency response of the equivalent circuit 900 obtained from CB simulations is also shown graphically in FIG. 12. As shown in FIG. 12, the equivalent circuit 900 accurately predicted the frequency response of the third-order FSS 200. A calculated frequency response of the third-order FSS 200 for non-normal angles of incidence (θ=15°, 30°, 45°, and 60°) is shown graphically in FIG. 13. As shown in FIG. 13, the transmission coefficient of the third-order FSS 200 is provided for an obliquely incident plane wave for various angles of incident ranges from zero degrees to sixty degrees (0° to 60°). The frequency response of the third-order FSS 200 was not considerably affected as the angle of incidence increases from zero degrees to forty-five degrees (0° to 45°). However, the frequency response of the third-order FSS 200 was affected as the angle of incidence increases from forty-five degrees to N degrees (45° to N°), where N is an integer greater than forty-five (45). Nevertheless, the structure demonstrated a rather stable frequency response as a function of angle of incidence without the aid of any dielectric superstrates that are commonly used to stabilize the frequency response of FSSs for oblique angles of incidence.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the following claims.

I claim:

1. A frequency selective surface-based (FSS-based) device for processing electromagnetic waves, comprising:

a first and second frequency selective surface (FSS) having first and second primary resonant frequencies, respectively;

a high quality factor (Q) FSS having a lower primary resonant frequency relative to said first and second primary resonant frequencies, said high Q FSS interposed between said first and second FSS and having a loaded Q of at least thirty at said lower primary resonant frequency;

a first dielectric layer interposed between said first FSS and said high Q FSS; and a second dielectric layer interposed between said second FSS and said high Q FSS.

2. The FSS-based device according to claim 1, wherein said high Q FSS comprises a plurality of dielectric comprising features formed in an electrically conductive layer.

3. The FSS-based device according to claim 2, wherein said high Q FSS comprises a plurality of slot antennas.

4. The FSS-based device according to claim 3, wherein said slot antennas comprise a straight slot having a set of balanced spirals disposed at each end of said straight slot.

5. The FSS-based device according to claim 3, wherein said slot antenna comprises a dual-polarized crossed slot antenna.

6. The FSS-based device according to claim 1, wherein a thickness of said FSS-based device is <λ/10, where λ is a wavelength of operation of said FSS-based device.

7. The FSS-based device according to claim 1, further comprising a plurality of FSS-based devices stacked together by sharing at least one common layer selected from said first and second FSS.

8. The FSS-based device according to claim 1, wherein said first and second primary resonant frequencies are each at least 1.3 times larger than said lower primary resonant frequency.

9. The FSS-based device according to claim 1, wherein said first and second primary resonant frequencies are each at least three times larger than said lower primary resonant frequency.

10. A system, comprising:

a propelled object or vehicle; and a frequency selective surface based (FSS-based) device coupled to said propelled object or vehicle, said FSS-based device configured for processing electromagnetic waves and comprising a substrate having a surface layer; and a multi-layer frequency selective surface (FSS) structure disposed on said surface layer, said multi-layer FSS structure comprising a first FSS having a first primary resonant frequency, a second FSS having a second primary resonant frequency, a high quality factor (Q) FSS interposed between said first FSS and said second FSS, a first dielectric layer interposed between said first FSS and said high Q FSS, and a second dielectric layer interposed between said second FSS and said high Q FSS;

wherein said high Q FSS has a lower primary resonant frequency relative to said first and second primary resonant frequencies and a loaded Q of at least thirty at said lower primary resonant frequency.

11. The system according to claim 10, wherein said high Q FSS comprises a plurality of dialectic comprising features formed in an electrically conductive layer.

12. The system according to claim 11, wherein said high Q FSS comprises a plurality of slot antennas.

13. The system according to claim 12, wherein said slot antennas comprise a straight slot having a set of balanced spirals disposed at each end of said straight slot.

14. The system according to claim 12, wherein said slot antenna comprises a dual-polarized crossed slot antenna.

15. The system according to claim 10, wherein a thickness of said multi-layer FSS structure is $<\lambda/10$, where $\lambda$ is a wavelength of operation of said FSS-based device.

16. The system according to claim 10, wherein said multi-layer FSS structure comprises a plurality of FSS-based devices stacked together by sharing at least one common layer selected from said first and second FSSs.

17. The system according to claim 10, wherein said first and second primary resonant frequencies are each at least 1.3 times larger than said lower primary resonant frequency.

18. The system according to claim 10, wherein each of said first and second primary resonant frequencies are each at least three times larger than said lower primary resonant frequency.

19. The system according to claim 10, wherein said propelled object or vehicle is an aircraft, a missile, or a ship.

* * * * *